US007331491B2

(12) United States Patent
King

(10) Patent No.: US 7,331,491 B2
(45) Date of Patent: Feb. 19, 2008

(54) CLOSURE ASSEMBLY WITH VALVE

(76) Inventor: Roger Milner King, White End Park Farm, Latimer (GB) HP5 1UL ( * ) Notice: Subject to any disclaimer, the term of this patent is extended or adjusted under 35 U.S.C. 154(b) by 418 days.

(21) Appl. No.: 10/482,726

(22) PCT Filed: Jul. 3, 2002

(86) PCT No.: PCT/GB02/03064

§ 371 (c)(1),
(2), (4) Date: Jun. 4, 2004

(87) PCT Pub. No.: WO03/004373

PCT Pub. Date: Jan. 16, 2003

(65) Prior Publication Data

US 2004/0232167 A1 Nov. 25, 2004

(30) Foreign Application Priority Data

Jul. 3, 2001 (GB) ..... 0116306.2
Jul. 10, 2001 (GB) ..... 0116861.6

(51) Int. Cl.
*B65D 47/24* (2006.01)

(52) U.S. Cl. ..... 222/521; 222/153.14; 222/541.9; 222/541.1

(58) Field of Classification Search ..... 222/519–521, 222/153.14, 541.1, 541.5, 541.6, 548, 549, 222/551, 541.9
See application file for complete search history.

(56) References Cited

U.S. PATENT DOCUMENTS 4,892,209 A * 1/1990 Dorfman et al. ..... 215/277
6,062,441 A * 5/2000 Mengeu et al. ..... 222/521
6,334,555 B1 * 1/2002 Randall et al. ..... 222/521

FOREIGN PATENT DOCUMENTS

| | | | |
|---|---|---|---|
| EP | 0 527 532 | * | 1/1993 |
| GB | 2 264 110 A | | 8/1993 |
| GB | 2 280 896 A | | 2/1995 |
| WO | WO 91/18799 | | 12/1991 |
| WO | WO 93/01098 | | 1/1993 |
| WO | WO 94/11267 | | 5/1994 |
| WO | WO 95/05322 | | 2/1995 |
| WO | WO 00/64774 | | 10/2000 |

* cited by examiner

*Primary Examiner*—J. Casimer Jacyna
(74) *Attorney, Agent, or Firm*—Stephen B. Salai; Dominic P. Ciminello; Harter Secrest & Emery LLP

(57) ABSTRACT

A container closure assembly includes: a container neck having a first thread on an outer surface thereof; a closure for the neck, the closure having an opening therein, a skirt extending downwardly, and a second thread on an internal surface of the skirt for engaging the first thread on the container neck; and complementary valve elements on the neck and the closure, wherein the valve elements engage to provide a fluid-tight seal over the neck when the closure is fully secured on the neck, but the valve elements allow fluid from the neck to flow out through the opening when the closure is at an intermediate position at which the closure is still retained on the neck, and wherein the closure is moveable from the fully secured position to the intermediate position by relative rotation of the closure and the neck. The assembly is especially useful on containers for carbonated or non-carbonated sports drinks.

29 Claims, 5 Drawing Sheets

CLOSURE ASSEMBLY WITH VALVE

BACKGROUND OF THE INVENTION

1. Field of the Invention

This invention relates to resealable closure assemblies that can provide rapid access to the contents of a container through a spout, without fully disengaging the closure from the container neck.

1. Description of Related Art

Closure assemblies for sports drinks are known, in which the closure is provided with a drinking spout and the assembly can be opened using one hand or by using the teeth.

Existing closures of this type include so-called push-pull closures. Typically, such closures comprise a main cap having a central opening in communication with the bore of a spout. The spout has a plug member that partially blocks the top of the bore. A top cap, also having a central aperture is mounted on the spout. The top cap is normally moveable axially between a first position and a second position. In the first position, the aperture in the top cap is sealed by the plug member, sealing the container. In the second position, the top cap aperture is not sealed by the plug member, allowing the container contents to exit the container around the plug member and through the aperture in the top cap. Closure assemblies of this type are described, for example, in WO00/64774. They have found wide application in fields outside sports drinks, for example on bottles of washing up liquid.

Certain other sports drink closures have an alternative configuration in which the pour spout can be opened by twisting. DE-A-4328582 describes such an arrangement However, these closures have a number of problems associated with them. One problem is the fact that the flow rate around the plug when the closure is in the open position can be inadequate.

In addition, the previously known spout closures often do not provide effective sealing at the juncture between the spout opening and the plug positioned in the opening when the spout is closed. This is because the closure is held in the sealing position only by frictional forces, and can work loose to allow leakage of the contents. This lack of efficient sealing also means that the standard push-pull closures are not effective for use on containers containing carbonated drinks. The seal formed by the closure is not sufficiently tight to prevent loss of gas from the container between filling and consumption, nor to prevent gas escaping once the container has been opened for the first time and then resealed for later consumption. Also, internal pressure caused by carbonisation would tend to open existing closures thereby causing leakage.

A further drawback of existing sports closures is that it is difficult to incorporate tamper-evident features. For example, GB-A-2264110 describes a tamper evident ring for such an assembly, but it is apparent that excessive force would be needed to achieve reliable separation of the ring in use.

It would also be desirable to provide a convenient sports drink closure assembly that can incorporate the pressure safety features for use with carbonated beverages that are described and claimed in WO95/05322, WO97/21602 and WO99/19228.

BRIEF SUMMARY OF THE INVENTION

According to the present invention, there is provided a container closure assembly comprising:

a container neck having a first thread on an outer surface thereof;

a closure for the neck, the closure having an opening therein, a skirt extending downwardly, and a second thread on an internal surface of the skirt for engaging the first thread on the container neck; and complementary valve elements on the neck and the closure, wherein the valve elements engage to provide a fluid-tight seal over the neck when the closure is fully secured on the neck, but the valve elements allow fluid from the neck to flow out through the opening when the closure is at an intermediate position at which the closure is still retained on the neck, and wherein the closure is moveable from the fully secured position to the intermediate position by relative rotation of the closure and the neck;

wherein the closure comprises a downwardly extending cylindrical plug seal that forms a sealing fit in a cylindrical bore of the container neck both when the closure is at the intermediate position and when the closure is at the sealing position on the neck to resist escape of fluid between the neck and the closure skirt when the closure is at the intermediate position;

wherein the valve elements comprise:

an inlet to the opening in the cap, wherein the inlet comprises a tubular inlet extending downwardly from the opening and having a circumferential sealing surface at the lower end thereof; and a complementary sealing plug located inside the container neck against which the sealing surface forms a fluid-tight seal when the closure is in the sealing position, wherein the sealing plug comprises a fluid-tight portion having a circumferential sealing surface complementary to the sealing surface of the said inlet, and one or more apertures located outside the circumferential sealing surface to allow passage of fluid through the plug.

The assembly of the invention makes use of a thread, i.e. a twist action instead of a push-pull action, to move the closure (herein also referred to as the "cap" or "closure cap") from a sealing position to an intermediate, pouring position. Preferably, the closure can be moved from the sealing position in the neck to the intermediate pouring position on the neck by relative rotation of the neck and the closure through an angle of less than 360 degrees, preferably from about 5 to about 180 degrees, more preferably an angle of from about 22.5 ($1/16^{th}$ turn) to about 90 degrees (1/4 turn), and most preferably about 45 degrees ($1/8^{th}$ turn). This enables easy opening and closing of the pour spout with one hand or with the teeth, for example by relative rotation of the cap and neck through about 45 degrees.

The term "threads" refers to any arrangement of interengaging projections or recesses on the neck and the closure that permit relative rotation of the closure and neck, but retain the closure on the neck at both the sealing and the pouring positions. Preferably, the threads screw threads, i.e. they permit relative movement of the cap and the neck along a substantially helical path. Preferably, the threads are steeply pitched screw threads. For example, the first and second threads preferably have a mean thread pitch of from about 5 to about 35 degrees, more preferably from about 10 to about 25 degrees. Preferably, the rotation from the sealing position to the pouring position moves the closure through an axial distance of from about 1 mm to about 10 mm, more preferably from about 2 mm to about 8 mm, depending on the neck size.

Preferably, at least one of the first and second threads has at least two, preferably four thread starts. Preferably, the thread segments follow a substantially continuous, preferably substantially helical thread path for the whole of the rotation as the closure is screwed onto the container neck, although the pitch of the helix may vary. The continuous thread path renders the assembly especially easy to close by the elderly and infirm, or by children. In contrast, bayonet-type threads require a relatively complex, stepped manipulation to secure the closure onto the container neck, with the result that the closure is often inadequately secured on the container neck.

The threads preferably include complementary stop elements on the neck and the closure to block or resist unscrewing of the closure at one or more of said intermediate, pouring positions at which the pour spout is in fluid communication with the interior of the neck. Preferably, the blocking feature can be overridden to enable complete cap removal, for example by further relative rotation of the neck and cap through from about $1/16^{th}$ to $1/4$ turn, preferably about $1/8^{th}$ turn, as described further below. The stop elements may comprise a projection on either the neck or the closure skirt. The projection may abut against and block a thread or other complementary projection on the closure skirt or the neck, respectively. Alternatively, the projection may be received in a complementary recess in the closure skirt or the neck, respectively. Thus, the closure is not normally removed completely when emptying the container through the opening. Instead, in normal use, it is held at the intermediate pouring position, whilst as aforesaid preferably retaining the option to remove the cap completely.

The feature to block or restrict unscrewing of the closure at an intermediate, pouring position preferably can be overridden without damage to the threads by applying a substantially increased torque or an axial force to the closure, or by a combination of pressing down on the closure and applying an unscrewing torque. This enables the closure to be removed completely to permit even easier or faster drinking or pouring, and also to enable refilling of the container through the neck of the assembly, if desired.

In preferred embodiments the assembly further comprises at least one guide thread on the neck or the closure skirt, wherein the guide thread is adapted to guide the complementary stop elements into engagement at the said intermediate position(s), and wherein the guide thread is further adapted to be overridden by application of an predetermined torque or axial force on the closure to enable the closure to be unscrewed past the said intermediate position(s). The guide thread will preferably be located between projecting thread elements of the first or second threads, and will normally have a lower profile (lower projecting height) than the thread elements between which it is located.

In certain embodiments a plurality of intermediate pouring positions of the closure on the neck may be defined by a plurality of blocking means on the threads, whereby one of the said intermediate position of the closure may be selected to give a predetermined maximum fluid flow rate through the assembly.

The assembly may further comprise elements that engage at one or more of the intermediate pouring positions to retain the closure at that position until a predetermined minimum closing torque is applied to close the closure. Such elements can provide the user with a "click" that can be heard and felt when the pouring position is reached, and thereby reduce the likelihood of accidental resealing of the assembly in use. Suitable elements would be a projection such as a longitudinal rib on one of the container neck and the closure skirt and a complementary recess on the other of the container neck and the closure skirt into which the projection is received at the intermediate position.

Preferably, the threads on the container neck and closure comprise the pressure safety features for use with carbonated beverages that are described and claimed in WO95/05322, WO97/21602 and WO99/19228, the entire contents of which are expressly incorporated herein by reference. Briefly, such closure assemblies further comprise mutually engageable elements on the neck and closure to block or restrict rotation of the closure in an unscrewing direction beyond an intermediate position when the closure is under an axial pressure in a direction emerging from the container neck, and the neck and closure are constructed and arranged to provide a vent for venting gas from the container neck at least when the closure is in the said intermediate position.

For example, in some embodiments incorporating the pressure safety feature, the screw threads on the container neck and the closure are constructed and arranged to permit axial displacement of the closure relative to the neck at least when the closure is at the said intermediate position, and wherein said mutually engageable elements are adapted to engage each other when the closure is axially displaced in a direction emerging from the neck. Preferably, the mutually engageable elements are constructed and arranged not to mutually engage each other when the closure is axially displaced in a direction inwardly towards the neck at the said intermediate position.

For example, the mutually engageable elements may comprise a step or recess formed in the lower surface of one of the neck or closure screw thread segments to provide a first abutment surface against which a second abutment surface on one of the respective complementary screw segments abuts to block or restrict rotation of the closure in an unscrewing direction at the intermediate position when the closure is under axial pressure in a direction emerging from the container neck.

The threads on the neck and/or on the closure may further comprise one or more axial, transverse, or helical gas venting grooves.

It is a further distinctive feature of the assemblies according to the present invention that the opening in the movable closure preferably comprises a pour spout secured directly to the neck portion, and more preferably the pour spout is integrally formed with the closure cap. This differs from push-pull assemblies, in which the pour spout is separate from the main cap, and the push-pull feature is provided by a moveable top cap on the pour spout.

The present invention comprises one or more sealing elements to resist escape of fluid from inside the neck through the gap between the neck and the closure skirt when the closure is at one of the intermediate, pouring positions. This is in addition to the sealing function when the closure is at the closed, sealing position in the neck. The sealing elements provide a seal that is both liquid-tight and air-tight, thereby preventing both escape of contents of the container and ingress of spoilage gases such as oxygen into the container. In preferred embodiments, the container and closure assembly in the closed position provides a pressure tight seal for storing a carbonated beverage, as discussed further below.

The sealing elements comprise a cylindrical plug seal that forms a sealing fit in a cylindrical bore of the container neck both when the closure is in the closed, sealing position, and when the closure is at the intermediate position. That is to say, the plug directly contacts the inside of the container neck. Preferably, the plug seal is in the form of a cylinder or tapered cylinder that forms an interference fit in the bore of the neck at the intermediate position. Preferably, the taper is very slight and the plug is resilient enough for the interference fit to be formed at both the sealing position and the pouring position of the closure.

The plug may be provided with one or more circumferential sealing ribs. Preferably, at least one of the sealing ribs has a substantially triangular cross-section. This enables the sealing force to be concentrated in the tip of the sealing rib to maximise sealing effectiveness. Preferably, at least one of the sealing ribs has a height in the range of 10 to 500 micrometers, more preferably 50 to 250 micrometers. Such micro sealing ribs are especially effective to concentrate the sealing force and achieve an effective seal with a substantially smooth sealing surface on the container neck. Furthermore, such micro ribs are especially easy to mould in high-speed cap moulding equipment, and to bump off the mould mandrel of the equipment after moulding.

A further advantage of using multiple sealing ribs on the sealing plug is that the plurality of sealing ribs may have more than one height in order to optimise sealing. For example, the height of the sealing rib closest to the base of the closure may be greater than the height of the sealing rib remote from the base of the closure. This allows the sealing rib closest to the base of the closure (i.e. closest to the lip of the container) to deform more that the sealing rib furthest from the base of the closure.

It will be appreciated that other sealing elements may be used additionally to the plug, for example circumferential sealing fins on the inside of the closure skirt or the outside of the container neck. The cap may also comprise a conventional compressible liner in the base thereof to form a seal with the neck in the closed and sealing position.

The valve elements may provide any valve that is opened and closed by relative rotation (with or without relative axial movement) of the closure and the neck. Preferably, the valve elements in the cap are formed integrally with the cap, for example by injection molding. The valve elements of the assembly according to this invention comprise: a tubular inlet extending downwardly from the base of the cap having a circumferential sealing surface at the lower end thereof; and a complementary sealing plug located inside the container neck against which the sealing surface forms a fluid-tight seal when the closure is in the sealing position. In this configuration the sealing plug is located inside the container neck and abuts against the lower lip of the tubular inlet when the closure is in the sealing position.

The sealing plug comprises: a fluid-tight portion having a circumferential sealing surface complementary to the sealing surface of the inlet, and one or more apertures located outside the circumferential sealing surface to allow passage of fluid through the plug. When the closure is in the sealing position, the abutment between the inlet of the pour spout and the fluid-tight portion of the plug prevents any fluid from entering the pour spout. When the closure is at the intermediate, pouring position, the fluid can flow radially inwardly into the pour spout. It is an advantage of this aspect of the invention that, because the sealing plug is formed in the relatively wide bore neck of the closure, it is possible to provide apertures in the plug that are sufficiently large to permit high flow rates of fluid out of the spout. This contrasts with known push-pull closures, which have a sealing plug in the spout itself.

Preferably, in assemblies according to this aspect of the invention, the sealing plug comprises an apertured diaphragm extending across the inside of the container neck. Typically the diaphragm has a fluid-impermeable central region surrounded by a sealing surface, and a number of fluid flow apertures circumferentially spaced around the sealing surface. Preferably, at least one of the complementary sealing surfaces on the inlet and the plug is provided with a circumferential sealing rib. such as the sealing ribs described in GB-A-2280896, the entire content of which is incorporated herein by reference. Preferably, at least one of the sealing ribs has a substantially triangular cross-section. This enables the sealing force to be concentrated in the tip of the sealing rib to maximise sealing effectiveness. Preferably, at least one of the sealing ribs has a height in the range of 10 to 500 micrometers, more preferably 50 to 250 micrometers.

Preferably, in assemblies according to this aspect of the invention, the sealing plug is snap-fitted into one or more circumferential recesses in the inside of the container neck.

Preferably, the assemblies according to the present invention further comprise mutually engageable elements on the container neck and on the closure skirt that engage when the closure is sealed or resealed on the neck and that resist unscrewing of the closure from the sealing position neck until a predetermined minimum unscrewing torque is applied. These elements help to prevent backing off of the closure from the sealing position, especially when the closure assembly is used for storage of pressurised materials such as carbonated beverages, and thereby reduce leakage from the sealed assembly. Furthermore, the elements normally provide a positive "click" sound and feel when the sealing position is reached, which helps the user to avoid under-tightening of the closure.

More preferably, the mutually engageable elements comprise a longitudinal locking rib on one of the container neck or on the skirt portion of the closure, and a complementary locking ramp on the other of the container neck or the skirt portion of the closure, wherein the locking rib abuts against a retaining edge of the locking ramp when the closure is fully engaged on the container neck. In alternative preferred embodiments, a locking recess such as a longitudinal groove may be provided in one or more of the first or second thread segments, and a longitudinal locking rib is provided on the other of the container neck or on the skirt portion of the closure, whereby the locking rib is received in the recess in the thread segments at the fully engaged and sealing position of the closure on the container neck. Locking means of this kind are described in detail in WO91/18799 and WO95/05322, the entire disclosures of which are expressly incorporated herein by reference.

Preferably, the assemblies according to the present invention further comprise one or more sealing stops on the container closure or the neck to block rotation of the closure on the neck in a sealing direction beyond a predetermined sealing position. This prevents over-tightening of the closure on the container neck that could damage the thread finish. Suitable thread stops are described for example in WO93/01098 and WO95/05322, the entire contents of which are incorporated herein by reference.

Preferably, the assemblies according to the present invention further comprise a tamper-evident ring attached to the closure skirt. Preferably, the tamper-evident ring is attached to the closure skirt by a plurality of frangible bridges and is retained on the container neck by a retaining lip on the neck, whereby unscrewing the closure from the sealing position to the pouring position causes the tamper evident ring to separate from the closure skirt by breaking the frangible bridges.

Especially suitable tamper-evident rings are described in WO94/11267, the entire contents of which are incorporated herein by reference.

The assemblies of the present invention are much better suited to tamper-evident rings than the push-pull closures previously used, because the rotation of the closure results in easier and more reliable separation of the tamper evident ring. Furthermore, the existing push-pull closures sometimes need two separate tamper-evident rings.

Preferably, the assemblies according to the present invention further comprise a tamper evident sealing membrane removably attached over the top of the opening (e.g. the pour spout) in the cap. This provides a further tamper-evident feature that is not possible with existing push-pull closure assemblies. Preferably, the tamper-evident membrane is one of those described in WO93/01098, the entire contents of which are incorporated herein by reference. In certain preferred embodiments, the tamper evident sealing membrane bears holographic security markings.

Preferably, the tamper evident sealing membrane comprises a pressure relief feature to assist venting of pressurised gases through the membrane. This is desirable, for example, when the assembly is used for storage of carbonated beverages, in which case a venting of gases through the membrane is needed when the container is opened for the first time. The pressure relief feature may, for example, comprise lines of weakness such as a die-cut cross in the membrane to assist opening of the membrane under pressure. Alternatively, the pressure relief feature may be provided by and interrupted bond between the membrane and the lip of the neck.

Preferably, the assemblies according to the present invention further comprise a removable and replaceable outer cap that is press-fitted or screw-fitted over the opening in the closure cap to prevent contamination of the pour spout. Preferably, gas venting apertures are provided in the outer cap. This is desirable, for example, when the assembly is used for storage of carbonated beverages, in which case a venting of gases through the outer cap is needed when the container is opened.

Preferably, the assemblies according to the present invention further comprise mutually engageable sealing surfaces on the container neck and the closure for forming a pressure-tight seal between the neck and the closure when the closure is at the sealing position, whereby the assembly can be used for storage of both carbonated and non-carbonated beverages.

The mutually engageable sealing surfaces include the sealing plug on the closure that forms an interference fit with the bore of the neck.

In certain embodiments the mutually engageable sealing surfaces further comprise one or more sealing fins extending downwardly from the closure that abut against a lip of the neck to form a pressure-tight seal when the closure is in the sealing position, with or without a compressible liner in the base of the cap.

In certain embodiments the mutually engageable sealing surfaces comprise at least one circumferential sealing rib, preferably as described in GB-A-2280896. Certain preferred embodiments of the pressure-tight sealing features are described and claimed in WO02/42171, the entire content of which is expressly incorporated herein by reference.

BRIEF DESCRIPTION OF THE SEVERAL VIEWS OF THE DRAWING(S)

By way of example, one embodiment of a container according to the invention will now be described with reference to the accompanying drawings, in which.

DETAILED DESCRIPTION OF THE INVENTION

Figure 1:
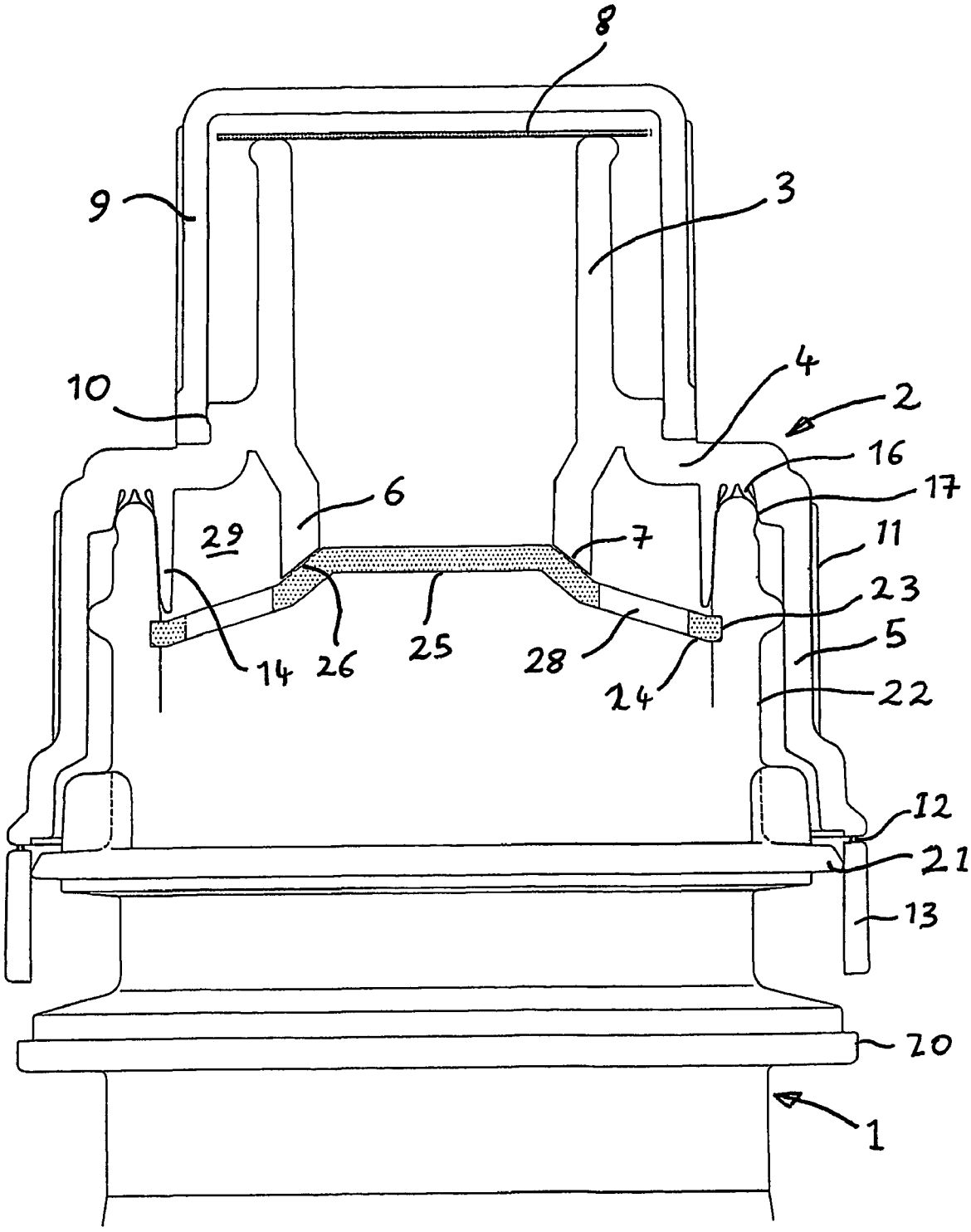
FIG. 1 shows a longitudinal sectional view of a container closure assembly according to the present invention with the closure in the closed, sealing position on the container neck.

Referring to FIG. 1, the assembly includes a container neck 1 and a closure 2. The neck is preferably formed by injection molding of plastic material, such as polyethylene terephthalate (PET). The neck is preferably formed integrally with a container body, such as a blow-molded carbonated beverage container. The closure (cap) is preferably formed by injection molding of a plastic material, such as polyethylene.

The closure comprises a pour spout 3 that comprises a smooth upwardly projecting surface shaped and configured to allow drinking directly therefrom, a base 4, and a skirt 5 extending downwardly from the base. The fluid inlet to the pour spout is in the form of an inlet tube 6 extending downwardly from the base and terminating in a bevelled circumferential sealing surface 7.

The top opening of the spout is covered by a tamper-evident membrane 8 that is thermally bonded to the spout and can be removed by peeling. The membrane 8 bears holographic security printing. Die-cut lines of weakness intersecting to form a cross extend across the membrane to provide controlled bursting of the membrane when the assembly is used to store for example a carbonated beverage. A removable and replaceable protective cap 9 is snap fitted over the upper spout portion by means of snap fitting 10. Preferably, this cap is formed of injection molded thermoplastic, such as a transparent thermoplastic, e.g. polymethyl methacrylate. A plurality of apertures (not shown) are formed in the cap to allow gases to vent through the cap when the assembly is used, for example, for storage of carbonated beverages.

The skirt portions of the closure 2 is provided with thread projections on the inside surface thereof that engage with the thread segments on the container neck, as described further below in relation to FIGS. 3 to 5. The outside surface of the skirt of the closure is provided with longitudinal ribbing 11 to improve gripping of the surface.

The lower edge of the closure skirt is attached through frangible bridges 12 to an integrally formed tamper-evident ring 13. The structure and operation of the tamper-evident ring are described in WO94/11267 and will not be detailed further here.

The closure further comprises a sealing plug 14 substantially in the form of a slightly tapered cylinder that forms a sealing interference fit in the bore of the container neck. Three circumferential sealing ribs of the type described in GB-2280896 having substantially equilateral triangular cross-section and height approximately 0.5 mm extend around the sealing plug to provide improved pressure-tight sealing.

The pressure-tight seal between the container neck and the closure is further strengthened by the presence of additional sealing elements substantially as described in WO02/42171. These comprise flexible fins 16 extending downwardly from the base of the skirt and forming a sealing abutment against the top of the container neck. The pressure-tight seal between the container neck and the closure is further strengthened by a sealing abutment in region 17 between the outer edge of the container lip and the closure skirt in the vicinity of the base.

The closure skirt is further provided near its lower edge with inwardly projecting elements for engagement with complementary elements on the container neck to provide a positive click when the sealing position is reached, to resist opening until a predetermined minimum opening torque is applied, and to prevent over-tightening of the closure on the neck. The structure and operation of these elements are described in detail in WO93/01098 and, and will not be detailed further here.

The neck 1 of the container comprises a bottom flange 20 for gripping the container neck in container production and filling lines, and a central flange 21 that acts as a retaining lip for the tamper-evident ring 13. Projections are provided on the container neck immediately above the central flange for engagement with complementary retaining elements on the closure, as hereinbefore described.

The container neck further comprises an upper portion 22 having a central cylindrical bore with a circumferential recess 23. Projecting thread segments are provided on the outer surface of the upper portion 22, as will be described in more detail in relation to FIGS. 3 to 5.

Into the recess 23 in the bore of the upper part of the container neck, there is snap-fitted a rigid plug 24 formed from injection molded plastic. A central region 25 of the plug 24 is fluid-impermeable and comprises a bevelled annular portion 26 that forms a fluid-tight seal with the bevelled lower surface 7 of the inlet tube 6 of the closure pour spout. The seal is strengthened by circumferential micro sealing ribs on the portion 26. The annular portion of the plug 24 surrounding the annular portion 26 is provided with openings 28 through which the contents of the container can pass into the chamber 29. However, liquid is prevented from passing from the chamber 29 into the inlet tube of the closure 3 in the closed position by the seal formed between the surfaces 7 and 26.

Figure 2:
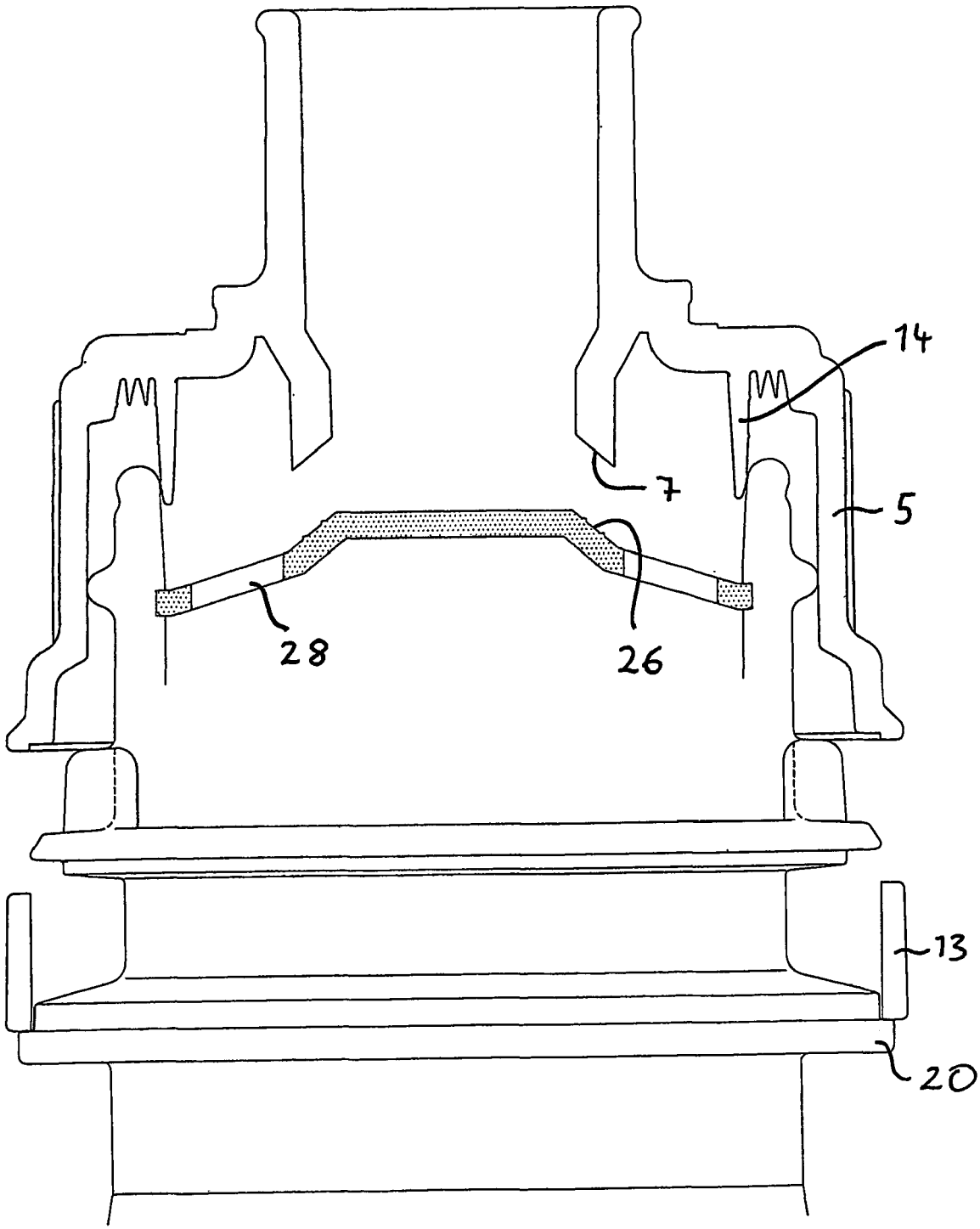
FIG. 2 shows a longitudinal sectional view of the container closure assembly of FIG. 1 with the closure in the intermediate, pouring position on the container neck.

Referring to FIG. 2, the assembly is shown in the intermediate, pouring position. The protective cap and tamper evident membrane have been removed. The tamper evident ring 13 has sheared away from the closure skirt 5 at the frangible bridges, and has dropped down onto the flange 20 on the neck to give a clear indication that the assembly has been opened.

At the intermediate, pouring position, the sealing surfaces 7 and 26 on the plug 24 and the inlet tube 6 are spaced apart, thereby allowing fluid to pass at high flow rates through the openings 24 and into the pour spout 3. Note that the plug 14 on the closure is still forming an interference sealing fit with the bore of the neck, whereby leakage of fluid between the neck and the closure skirt is prevented.

Figure 3:
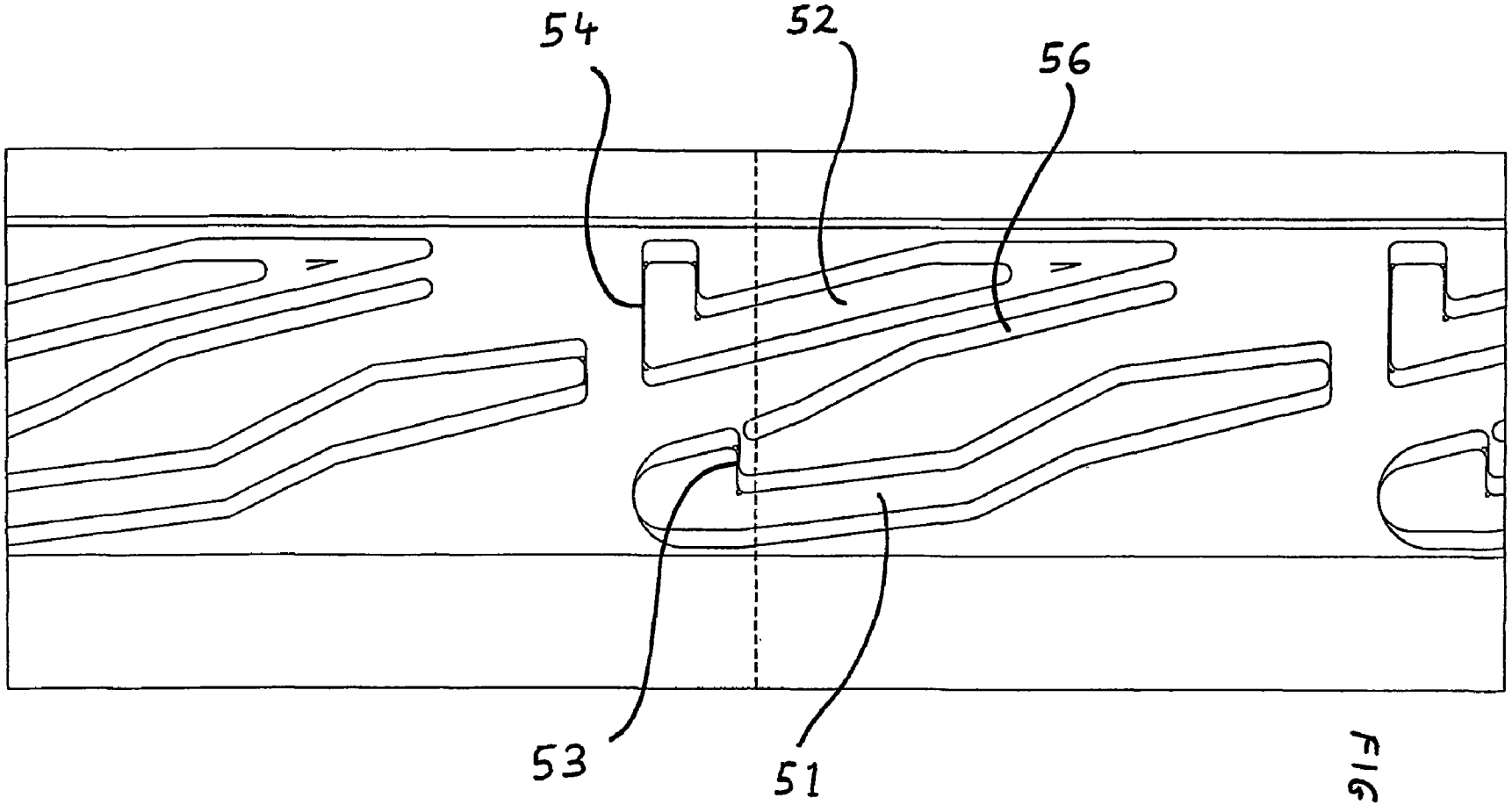
FIG. 3 shows a partial plane projection (180 degrees only) of the screw thread on the closure of the assembly of FIG. 1.
Figure 4:
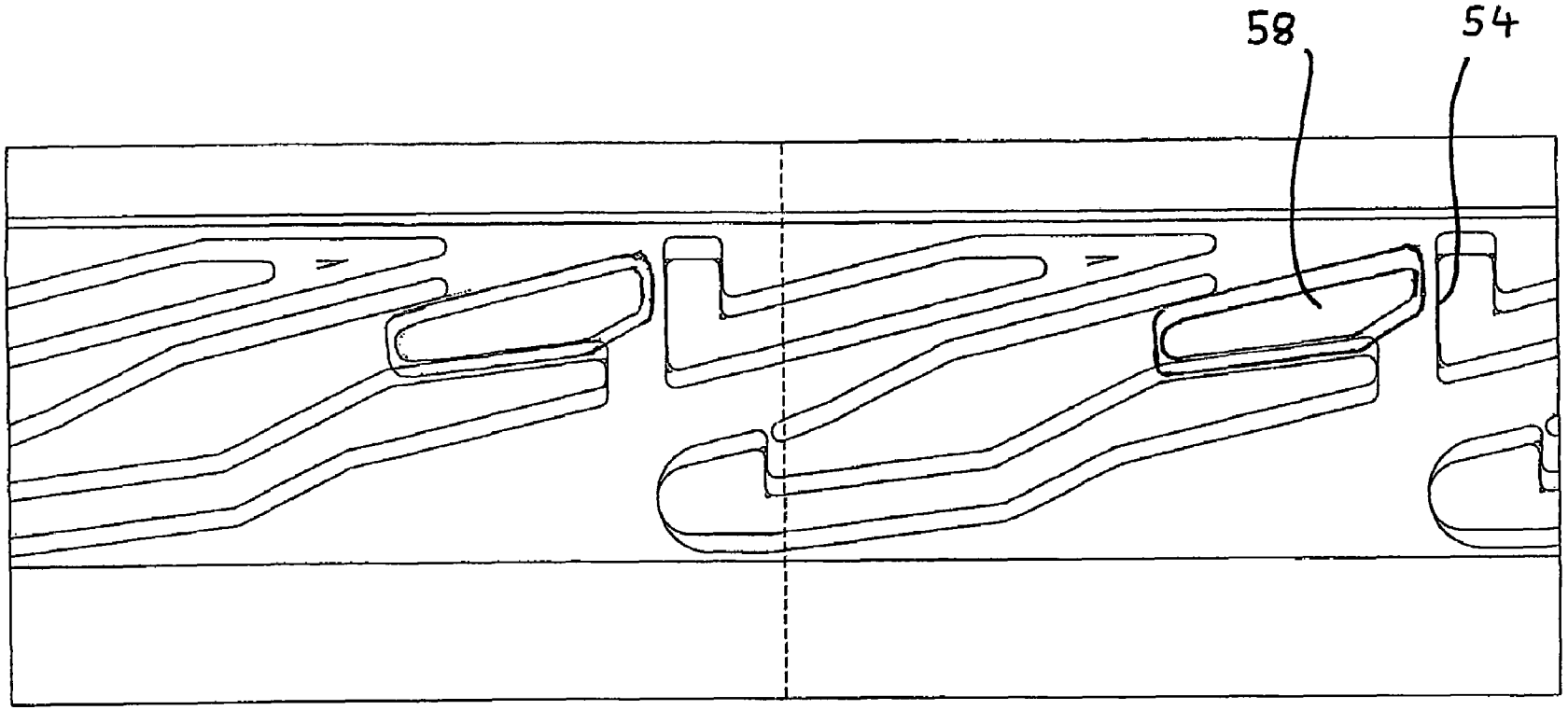
FIG. 4 shows the partial plane projection of FIG. 3, with the screw threads of the neck also shown at the closed, sealing position of the closure.
Figure 5:
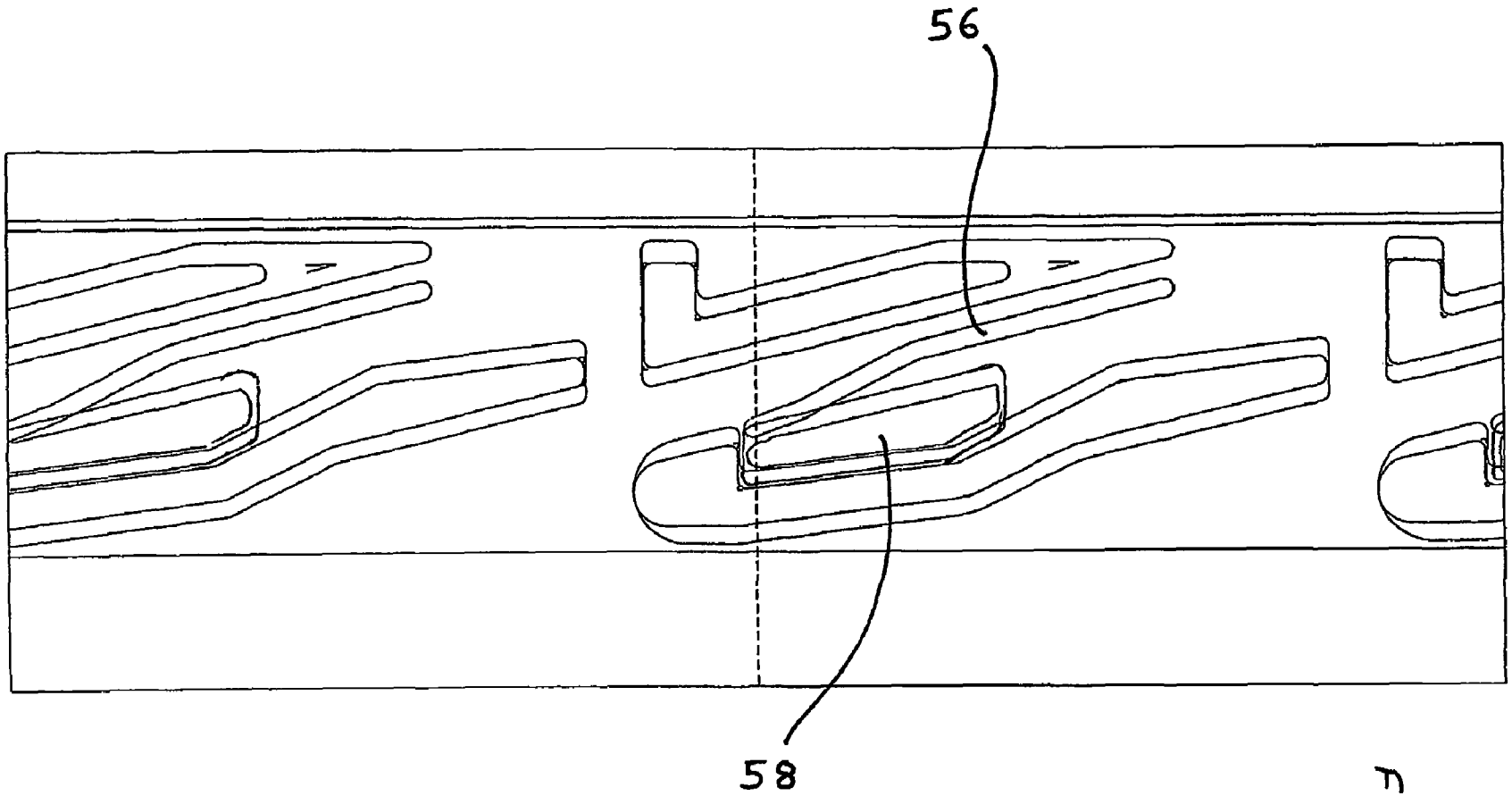
FIG. 5 shows the partial plane projection of FIG. 3, with the screw threads of the neck also shown at the intermediate, pouring position of the closure.

Referring to FIGS. 3 to 5, the cap thread is a four-start thread comprising lower thread segments 51 and upper thread segments 52. The cross-section of the thread segments is substantially trapezoidal. The lower thread segments 51 have at a lower end thereof a step 53 that acts to obstruct unscrewing of the closure from the container neck when the closure is at the intermediate, pouring position, as shown in FIG. 4. The upper thread segments 52 terminate in an abutment surface 54 that blocks further rotation of the thread segments 58 on the closure cap when the cap reaches the fully sealed position on the neck, and thereby prevents overtightening of the closure, as shown in FIG. 4. In this particular embodiment the threads can be moved from the fully sealing position to the intermediate position by relative rotation of the cap and the closure through about 45 degrees ($1/8^{th}$ turn). However, it will be appreciated that the amount of relative rotation can be adjusted within wide limits.

The closure thread further comprises a guide thread 56 intermediate the upper and lower thread segments. The guide thread 56 projects less far than the thread segments 51, 52 and the neck threads can therefore be caused to ride over the guide thread by application of a predetermined override force. The guide thread is configured to guide the thread segments 58 on the neck into abutment with the step 53 when the closure is unscrewed from the sealing position. The user can still remove the closure completely, for example to pour directly from the neck or to refill the container, by pushing down on the closure at said intermediate position in order to override the guide thread 56, followed by unscrewing the closure until the cap is fully released from the bottle neck. Likewise, the closure (cap) can be secured and resecured onto the container neck by screwing down with sufficient torque for the neck threads to ride over the guide threads.

It will be appreciated in alternative embodiments, that the neck and closure threads described herein may be reversed, so as to provide the short single thread segments 58 on the closure finish and the first and second thread segments 51, 52 and the guide thread 56 on the neck, without altering the operation of the assembly.

It will be appreciated that the foregoing description is by way of example only and that alterations or modifications may be made within the scope of the invention as defined in the accompanying claims.

The invention claimed is:

1. A container closure assembly comprising:

a container neck having a first thread on an outer surface thereof;

a closure for the neck, the closure having an opening therein, a skirt extending downwardly, and a second thread on an internal surface of the skirt for engaging the first thread on the container neck; and complementary valve elements on the neck and the closure, wherein the valve elements engage to provide a fluid-tight seal over the neck when the closure is fully secured on the neck, but the valve elements allow fluid from the neck to flow out through the opening when the closure is at an intermediate position at which the closure is still retained on the neck, and wherein the closure is moveable from the fully secured position to the intermediate position by relative rotation of the closure and the neck wherein the valve elements comprise: a tubular inlet extending downwardly from the opening in the cap, wherein the inlet comprises a circumferential sealing surface at the lower end thereof; and a complementary sealing plug having an apertured diaphragm extending across the inside of the container and forming a fluid-tight seal with the circumferential sealing surface when the closure is in the sealing position.

2. A container closure assembly according to claim 1 wherein the closure can be moved from the fully secured position in the neck to the intermediate position on the neck by relative rotation through an angle of from about 5 to about 360 degrees.

3. A container closure assembly according to claim 2 wherein the closure can be moved from the fully secured position in the neck to the intermediate position on the neck by relative rotation through an angle of from about 10 to about 180 degrees.

4. A container closure assembly according to claim 1, wherein the first and second threads are screw threads having a mean thread pitch of from about 5 to about 35 degrees.

5. A container closure assembly according to claim 1, further comprising one or more sealing elements to resist escape of fluid between the neck and the closure skirt when the closure is at the intermediate position.

6. A container closure assembly according to claim 5, wherein the sealing elements comprise a cylindrical plug seal that forms a sealing fit in a cylindrical bore of the container neck both when the closure is at the intermediate position and when the closure is at the sealing position on the neck.

7. A container closure assembly according to claim 1, wherein the sealing plug comprises: a fluid-tight portion having a circumferential sealing surface complementary to the sealing surface of the said inlet, and one or more apertures located outside the circumferential sealing surface to allow passage of fluid through the plug.

8. A container closure assembly according to claim 7 wherein the sealing plug is snap-fitted into one or more recesses in the inside of the container neck.

9. A container closure assembly according to claim 1, wherein at least one of the complementary sealing surfaces on the inlet and the plug is provided with a sealing rib.

10. A container closure assembly according to claim 1 further comprising complementary stop elements on the neck and the closure to block or restrict rotation of the closure on the container neck beyond the intermediate position at which the closure is still retained on the neck.

11. A container closure assembly according to claim 10, wherein the complementary stop elements comprise a projection on one of the closure skirt or the neck against which a complementary projection or a thread element on the other of the closure skirt or the neck abuts at the intermediate pouring position.

12. A container closure assembly according to claim 10, wherein the complementary stop elements are adapted to be overridden by application of an predetermined torque or axial force on the closure to enable the closure to be rotated past the said intermediate position(s).

13. A container closure assembly according to claim 10, wherein the assembly further comprises at least one guide thread on the neck or the closure skirt, wherein the guide thread is adapted to guide the complementary stop elements into engagement at the said intermediate position(s).

14. A container closure assembly according to claim 1, further comprising mutually engageable elements on the container neck and on the closure skirt that engage when the closure is sealed or resealed on the neck and that resist rotation of the closure from the fully secured position on the neck until a predetermined minimum unscrewing torque is applied.

15. A container closure assembly according to claim 1, further comprising one or more sealing stops on the container closure or the neck to block rotation of the closure on the neck in a sealing direction beyond a predetermined fully secured position.

16. A container closure assembly according to claim 1, further comprising a tamper-evident ring attached to the closure skirt.

17. A container closure assembly according to claim 1, further comprising a tamper evident sealing membrane removably attached over the top of the opening.

18. A container closure assembly according to claim 17, wherein the tamper evident sealing membrane bears holographic security markings.

19. A container closure assembly according to claim 17, wherein the tamper evident sealing membrane comprises a pressure relief feature to assist venting of pressurized gases through the membrane.

20. A container closure assembly according to claim 1, further comprising a removable and replaceable outer cap situated over the opening.

21. A container closure assembly according to claim 20, wherein the removable and replaceable cap is provided with one or more apertures to enable venting of gases through the outer cap.

22. A container closure assembly according to claim 1, further comprising mutually engageable sealing surfaces on the container neck and the closure for forming a pressure-tight seal between the neck and the closure when the closure is at the fully secured position, whereby the assembly can be used for storage of both carbonated and non-carbonated beverages.

23. A container closure assembly according to claim 22, wherein the mutually engageable sealing surfaces comprise a sealing plug on the closure that forms an interference fit with the bore of the neck.

24. A container closure assembly according to claim 22, wherein the mutually engageable sealing surfaces comprise one or more sealing fins extending downwardly from the closure that abut against a lip of the neck to form a pressure-tight seal when the closure is in the sealing position.

25. A container closure assembly according to claim 1, wherein the opening in the cap comprises a pour spout formed integrally with the cap.

26. A container closure assembly comprising:

a container neck having a first thread on an outer surface thereof;

a closure cap for the neck, the closure having an opening therein, a skirt extending downwardly, and a second thread on an internal surface of the skirt for engaging the first thread on the container neck; and complementary valve elements on the neck and the closure, wherein the valve elements engage to provide a fluid-tight seal over the neck when the closure is fully secured on the neck, but the valve elements allow fluid from the neck to flow out through the opening when the closure is at an intermediate position at which the closure is still retained on the neck, and wherein the closure is moveable from the fully secured position to the intermediate position by relative rotation of the closure and the neck, a tamper evident sealing membrane removably attached over the top of the opening wherein the tamper evident sealing membrane comprises a pressure relief feature to assist venting of pressurized gasses through the membrane.

27. A container closure assembly according to claim 26 wherein the valve elements comprise: an inlet to the opening in the cap, wherein the inlet comprises a circumferential sealing surface at the lower end thereof; and a complementary sealing plug on the container neck against which the sealing surface forms a fluid-tight seal when the closure is in the sealing position.

28. A container closure assembly according to claim 27, wherein the inlet to the opening is a tubular inlet extending downwardly from the opening, and the sealing plug is located inside the container neck.

29. A container closure assembly according to claim 27 or 28, wherein the sealing plug comprises: a fluid-tight portion having a circumferential sealing surface complementary to the sealing surface of the said inlet, and one or more apertures located outside the circumferential sealing surface to allow passage of fluid through the plug.

* * * * *